United States Patent [19]

Johnson

[11] Patent Number: 4,799,321

[45] Date of Patent: Jan. 24, 1989

[54] IRONING BOARD

[76] Inventor: Leo D. Johnson, 405 - 1445 W. 14th Ave., Vancouver, Canada, V6H 1R5

[21] Appl. No.: 4,199

[22] Filed: Jan. 16, 1987

[51] Int. Cl.[4] ..... D06F 81/00

[52] U.S. Cl. ..... 38/103; 38/104; 108/97

[58] Field of Search ..... 38/103, 104, 137, 138, 38/139, 112; 108/90, 97, 152; 312/282

[56] References Cited

U.S. PATENT DOCUMENTS

| | | | |
|---|---|---|---|
| 1,176,980 | 3/1916 | Pauli . | |
| 1,242,461 | 10/1917 | McDivitt . | |
| 1,337,936 | 4/1920 | Martindale | 38/137 |
| 2,210,648 | 8/1940 | Battelle | 38/104 X |
| 2,432,932 | 12/1947 | Peters | 38/103 |
| 2,486,606 | 11/1949 | Lantz | 108/97 X |
| 2,514,702 | 7/1950 | Lantz | 108/97 X |
| 2,746,186 | 5/1956 | Brown | 38/138 |
| 2,808,667 | 10/1957 | Witmer | 38/139 |
| 3,259,082 | 7/1966 | Williams | 108/97 X |
| 3,688,706 | 9/1972 | Merryweather | 108/97 X |

*Primary Examiner*—Louis K. Rimrodt
*Assistant Examiner*—J. L. Olds
*Attorney, Agent, or Firm*—Klarquist, Sparkman, Campbell, Leigh & Whinston

[57] ABSTRACT

An ironing board which is designed to be supported in a standard drawer is disclosed. The board has a transverse vertical ridge adjacent one edge which prevents it from being pulled out of the drawer, and a slidable saddle which fits over the top edge of the drawer to adapt the board to different drawer configurations.

6 Claims, 4 Drawing Sheets

IRONING BOARD

BACKGROUND OF THE INVENTION

The present invention relates to ironing boards and more particularly to an ironing board which is not supported by legs, but rather utilizes a standard drawer for support.

Existing ironing boards typically have folding legs which fold under the board when it is not in use so that the board may be stored more compactly. Such ironing boards, however, are not readily carried by the weak or elderly, and are not convenient where space is restricted. Furthermore, they are bulky and heavy to transport.

Various attempts have been made to design an ironing board which dispenses with legs to allow it to be more conveniently transported. Typically these designs have involved a folding board. For example, U.S. Pat. No. 2,746,186 entitled "Sectional Ironing Board" issued May 22, 1956 to E. M. Brown discloses a collapsible ironing board. Rather than utilizing legs, the device has spaced lugs which engage against the inside face of a drawer, and a brace which is swung down against the outside face of the drawer. While this device does not require folding legs, it does still require some manipulating in order to set it up properly and the number of separate pieces involved makes it relatively expensive to manufacture in large quantities.

Another folding ironing board is disclosed in U.S. Pat. No. 2,806,667 issued Aug. 29, 1955 to Witmer. Again this ironing board is designed to be supported by a standard drawer. In this device a panel is secured to the undersurface of the board at one end, extending rearwardly, so that when the drawer of a bureau or desk is partly opened, the board can be inserted with the panel extending below the bridge piece of the drawer with the outer end of the panel engaging the upper margin of the inner wall of the drawer and the inner end of the ironing board engaging the lower margin of the bridge and resting upon the upper edge of the drawer. Such a design may suitably fit a drawer which fits flush with the bridge piece of the drawer when closed, but does not operate properly when the drawer is of a type that overlaps the bridge piece. Furthermore, the ironing board can be easily dislodged from the drawer by pulling it outwardly, and as a result this particular design is not as stable or safe as is desirable.

The present invention provides an ironing board which is adapted to be supported by standard drawers. The invention includes a board element having an ironing surface, a ridge located on the top of the ironing surface adjacent one end and perpendicular to the length of the board, and two parallel ridges on the undersurface of the board, perpendicular to the length of the board, and adapted to receive the upper edge of a drawer panel. The drawer-receiving groove may be mounted on a sliding unit which allows the board to be adapted to different styles of drawers while retaining the ironing board essentially horizontal in use. The board may also be provided with a tapered end to fit into different sized drawers.

BRIEF DESCRIPTION OF THE DRAWINGS

In drawings which illustrate an embodiment of the invention.

Figure 3:
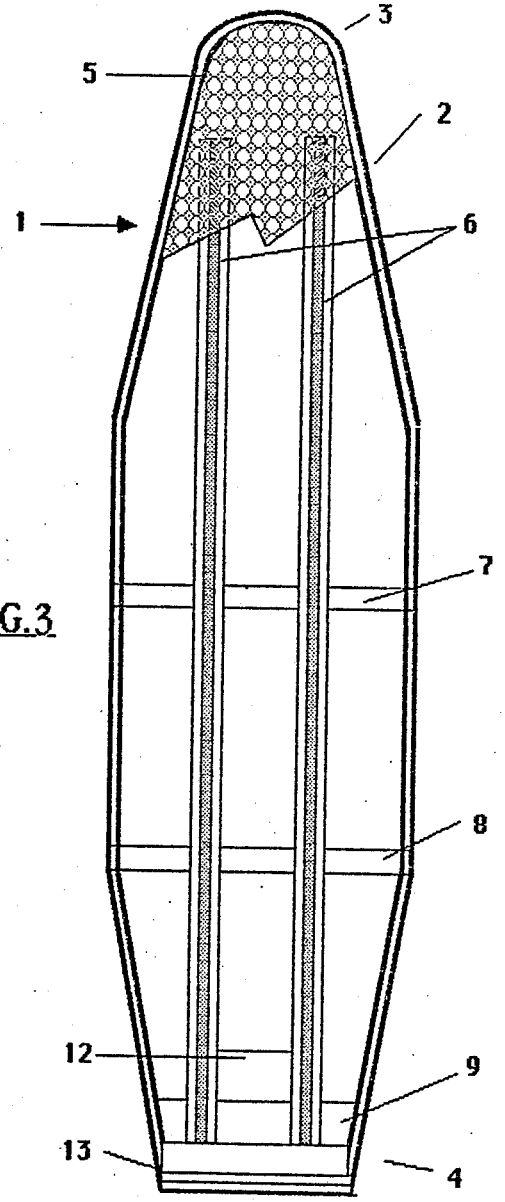
FIG. 3 is a top view of the ironing board shown in FIG. 1.
Figure 4:
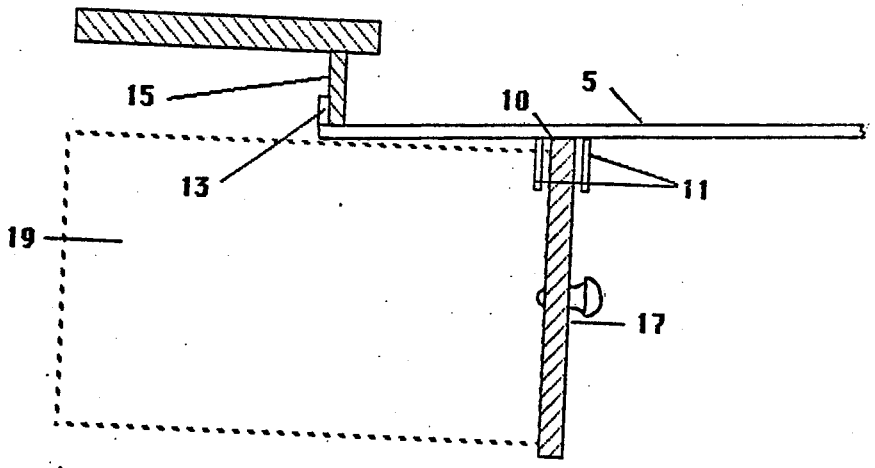
FIG. 4 is a side view, in cross-section, showing the ironing board of the present invention in place on a drawer; and, FIG. 5 is a perspective view of the ironing board of the present invention in operation.
Figure 5:
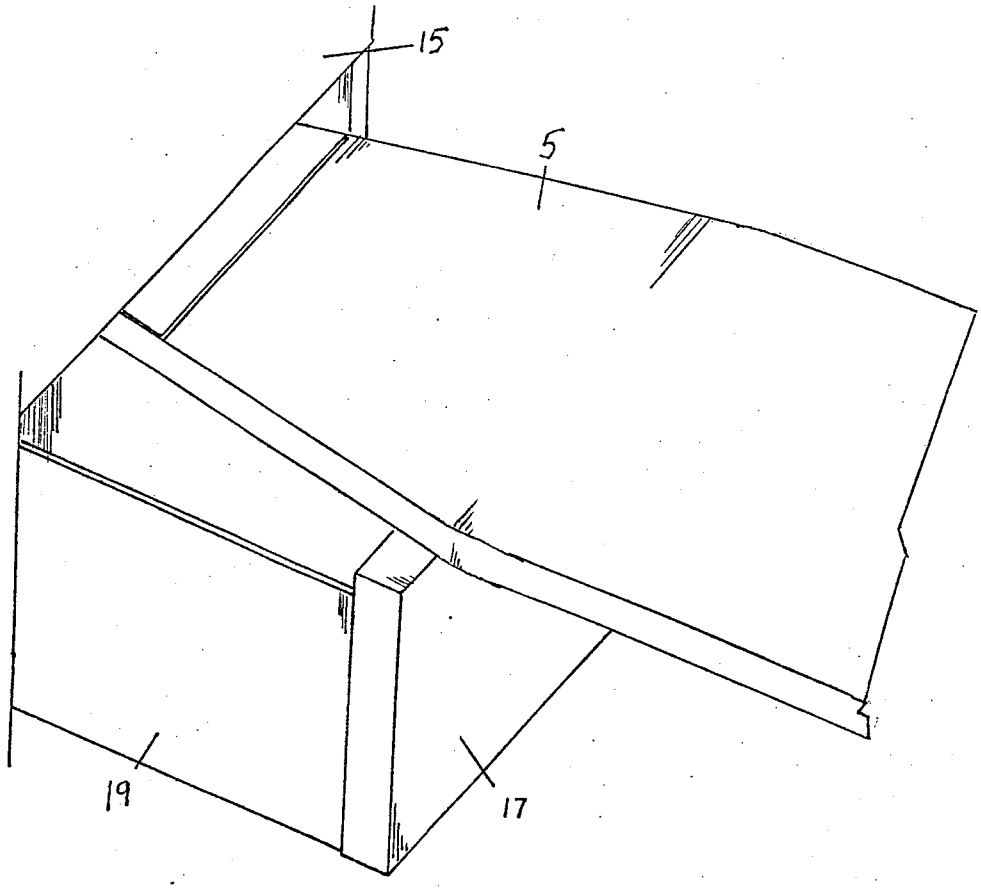

The ironing board of the present invention is designated generally as 1, consisting of a metal frame 2 having an operating end 3 which is tapered in the usual way to facilitate ironing of garments. The opposite end of the board 4 is also tapered to allow it to be inserted into a drawer opening. The upper surface of the board forms an ironing surface which may be formed of a metal mesh 5 to add to the lightness and flexibility of the board, although other materials may be utilized for the ironing surface. The ironing surface is reinforced by two longitudinal reinforcing elements 6. These are shown in FIG. 3 as having lengthwise recesses in their upper surface for lightness and strength. Three transverse reinforcing bars 7, 8 and 9 are also provided to reinforce the frame.

Figure 1:
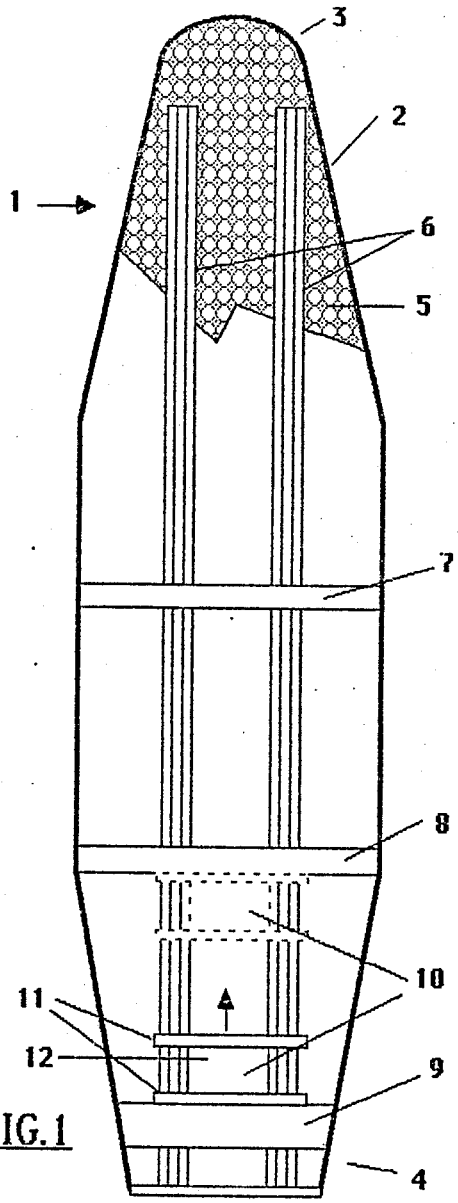
FIG. 1 is a plan view of the ironing board of the invention from below.

Mounted for sliding longitudinally between the two parallel bars 6 and between reinforcing bars 8 and 9 is a saddle 10 consisting of two vertical plates 11 secured to a horizontal plate 12 which runs in horizontal slots in the two parallel elements 6. The saddle is thus able to slide between two extreme positions, the first shown in solid outline in FIG. 1, and the second shown in dotted outline. The inner edges of plates 11 may have padding 22 to prevent damage to the surfaces of the drawer.

Figure 2:
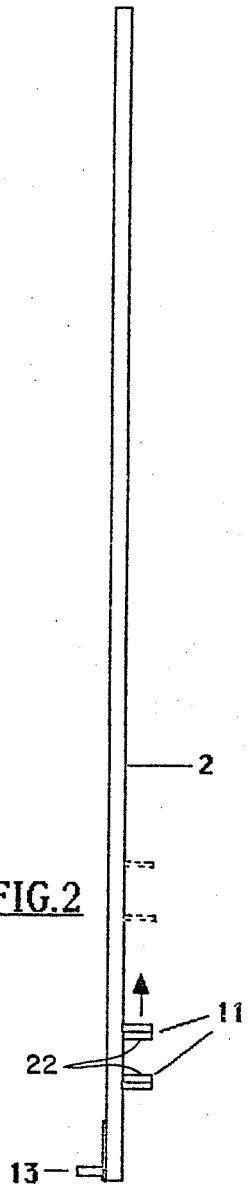
FIG. 2 is a side view of the ironing board shown in FIG. 1.

The upper surface of the ironing board also has a ridge 13 shown in FIG. 2 extending transversely across the upper edge of the board.

In operation, the tapered end 4 of the ironing board is inserted into an open drawer. The drawer has a bridge piece 15, the drawer portion 19 shown in dotted outline, and a front piece 17. Ridge 13 on the upper surface of the ironing board is hooked behind the bridge piece 15. The saddle 10 is then placed over the front piece 17 of the drawer. The drawer may then be pulled out until the saddle abuts against perpendicular reinforcing bar 8. In this way, the ironing board surface can be lowered approximately to the horizontal, while there is no danger that the ironing board can be pulled out of the drawer. By sizing the space between plates 11 so that saddle 10 fits snugly over drawer piece 17, side-to-side movement of the ironing board is minimized.

By manufacturing the ironing board from a flexible light aluminum or similar metal, sufficient flexibility can be provided in the board so that it can be utilized in any drawer structure. Similarly, the tapered end 4 of the board structure allows it to fit into smaller drawer openings.

As will be apparent to persons skilled in the art, various modifications and adaptations of the structure above described are possible without departure from the spirit of the invention, the scope of which is defined in the appended claims.

I claim:

1. An ironing board that is adapted to be supported in a standard drawer having a vertical face piece comprising:

(a) an ironing board having an upper planar ironing surface with a first working end, a planar undersurface parallel to said upper surface, and a second end distant from said first end;

(b) a transverse ridge adjacent the second end of said ironing board distant from said first end and extending vertically from said upper ironing surface; and, (c) two parallel ridges on the undersurface of said ironing board which together cooperate to form a groove adapted to receive the vertical face piece of the drawer.

2. The ironing board of claim 1 wherein said parallel ridges are slidably mounted for movement in a longitudinal direction.

3. The ironing board of claim 2 wherein said second end is tapered in the width-wise direction.

4. The ironing board of claim 2 wherein said two parallel ridges are secured to a horizontal plate mounted for longitudinal sliding movement between two parallel longitudinal support elements.

5. The ironing board of claim 4 wherein the space between said parallel ridges is selected to approximate the width of said drawer face piece.

6. The ironing board of claim 5 wherein the inner faces of said parallel ridges are provided with a resilient padding.

* * * * *